US006355143B1

(12) United States Patent
Kilian et al.

(10) Patent No.: US 6,355,143 B1
(45) Date of Patent: Mar. 12, 2002

(54) METHOD AND DEVICE FOR OIL EVACUATION FROM A SHOE PRESS UNIT

(75) Inventors: Malin Kilian; Lars Gustavsson; Jonas Eriksson, all of Karlstad (SE); Jorma Snellman; Antti Ilmarinen, both of Jyvaskyla (FI); Erik Brox, Forshaga; Christer Malmros, Karlstad, both of (SE)

(73) Assignee: Valmet-Karlstad AB, Karlstad (SE)

( * ) Notice: Subject to any disclaimer, the term of this patent is extended or adjusted under 35 U.S.C. 154(b) by 0 days.

(21) Appl. No.: 09/723,209

(22) Filed: Nov. 27, 2000

(30) Foreign Application Priority Data

Nov. 26, 1999 (SE) ..... 990428

(51) Int. Cl.[7] ..... D21F 3/02

(52) U.S. Cl. ..... 162/199; 162/272; 162/358.3; 162/361

(58) Field of Search ..... 162/199, 272, 162/358.3, 358.5, 361; 100/153; 492/20

(56) References Cited

U.S. PATENT DOCUMENTS 4,308,096 A * 12/1981 Cronin ..... 162/358.3
4,917,768 A * 4/1990 Ilmarinen ..... 162/358.3
5,084,137 A 1/1992 Ilmarinen et al.
5,302,252 A * 4/1994 Gotz ..... 162/358.5
5,645,691 A * 7/1997 Zuefle et al. ..... 162/272
5,935,385 A * 8/1999 Grabscheid et al. ..... 162/358.3

* cited by examiner

*Primary Examiner*—Karen M. Hastings
(74) *Attorney, Agent, or Firm*—Alston & Bird LLP

(57) ABSTRACT

A shoe press unit comprises a support beam, a shoe element movably supported on the beam, a pressing unit arranged between the beam and the shoe element for urging the shoe element away from the beam and toward a counter element, and a flexible belt that is arranged to slide over the pressing surface of the shoe element. An oil evacuation arrangement formed separately from the shoe element is affixed to the shoe element proximate an upstream edge region thereof. The oil evacuation arrangement has an inlet opening located such that a major portion of the excess oil expelled from between the belt and the shoe element passes through the inlet opening with a kinetic energy that is substantially undiminished from the initial kinetic energy of the oil as it exits from between the belt and the pressing surface of the shoe element.

20 Claims, 2 Drawing Sheets

46B
43B
47
42
46
46A
41
4
45
43A
44
8

METHOD AND DEVICE FOR OIL EVACUATION FROM A SHOE PRESS UNIT

FIELD OF THE INVENTION

The present invention relates to shoe press units used, for example, in papermaking for pressing a paper web. The invention relates more particularly to a method and a shoe press unit in which excess lubricating oil that is expelled from between a pressing surface of a press shoe and a flexible belt is captured and evacuated from the shoe press unit.

BACKGROUND OF THE INVENTION

A shoe press unit typically comprises a support beam, a shoe element movably supported on the beam, a pressing unit arranged between the beam and the shoe element for urging the shoe element away from the beam and toward a counter element such as a counter roll, and a flexible belt that is arranged to slide over the pressing surface of the shoe element. To reduce friction between the belt and the shoe element and thereby reduce the frictional heating of the belt, it is common to supply a lubricating oil between the pressing surface of the shoe element and the belt. The oil both lubricates and cools the belt and the pressing surface. Excess oil is expelled from between the belt and the pressing surface as a result of the pressure exerted in the nip between the shoe element and the counter element. The excess oil is expelled from an upstream edge region of the pressing surface, and is then evacuated from the shoe press unit by an oil evacuation arrangement.

U.S. Pat. No. 5,084,137 discloses a shoe press unit having an oil evacuation arrangement in which an inlet opening of the oil evacuation arrangement is formed in a lower integral part of the shoe element. The inlet opening is so located that the initial kinetic energy of the excess oil exiting from between the belt and pressing surface is lost before the excess oil passes through the inlet opening. Thus, this kinetic energy of the oil is not utilized to assist in evacuating the oil. Another disadvantage of the oil evacuation arrangement is that it does not prevent the excess oil from flowing in various directions within the shoe press unit, and hence the oil tends to accumulate in the shoe press unit. The accumulated oil tends to mix with air, which makes evacuation of the oil more difficult and also requires a subsequent processing of the evacuated oil to separate the air from the oil prior to reusing the oil. The accumulated oil, which is relatively hot because of the heat transfer from the belt to the oil, also tends to conduct heat to other parts of the shoe press unit before it is evacuated, which results in an undesirable temperature increase inside the shoe press unit. Moreover, it is disadvantageous to have an accumulation of oil in the shoe press unit because this requires an increased power consumption. Finally, constructing the oil evacuation arrangement as an integral part of the shoe element requires relatively costly manufacturing methods.

SUMMARY OF THE INVENTION

The present invention addresses the above and other needs by providing a method and a shoe press unit in which an oil evacuation arrangement is formed separately from the shoe element and is affixed to the shoe element proximate an upstream edge region of its pressing surface, such that the shoe element and oil evacuation arrangement move together as a unit. The oil evacuation arrangement has an inlet opening located with respect to the shoe element such that a major portion of the excess oil expelled from between the belt and the shoe element passes through the inlet opening with a kinetic energy that is substantially undiminished from the initial kinetic energy of the oil as it exits from between the belt and the pressing surface of the shoe element. Accordingly, a large part of the kinetic energy of the oil is useful for assisting in evacuating the oil.

In accordance with a preferred embodiment of the invention, the oil evacuation arrangement comprises a container having a bottom and a plurality of wall elements upstanding from the bottom. The excess oil is squirted out from between the belt and pressing surface through the inlet opening into the container. An evacuation duct formed in the bottom of the container evacuates the oil. Accordingly, the hot oil is evacuated before it has an opportunity to conduct a significant amount of heat to other parts of the shoe press unit, thereby allowing the temperature in the shoe press unit to be maintained at a lower level. Furthermore, the oil does not accumulate inside the shoe press unit and hence does not tend to be mixed with air, and the energy consumption of the shoe press unit is reduced because only a very small quantity of oil accumulates in the shoe press unit.

Preferably, the upstream edge region of the shoe element includes a convex curved surface and the belt is arranged to first contact the curved surface along a contact line X that extends in the cross-machine direction of the shoe element. The inlet opening is arranged such that a tangent $T_x$ to the curved surface at the contact line X extends into the inlet opening. More specifically, the tangent $T_x$ preferably either coincides with one of, or is between, two imaginary lines Y1 and Y2 that respectively extend from the contact line X to first and second delimiting surfaces that bound downstream and upstream sides of the inlet opening.

In a preferred embodiment, the oil evacuation arrangement includes at least one partition that extends from a surface of the shoe element to the inlet opening for preventing or at least substantially reducing oil flow between the shoe element and the first delimiting surface of the inlet opening. The partition(s) can be integrally formed with one of the wall elements of the container. The container and partition(s) advantageously can be formed of sheet metal, and hence can be inexpensively made.

The delimiting surface of the inlet opening that is nearest the belt preferably is spaced not more than about 10 mm from the belt during operation, and more preferably is spaced less than 5 mm from the belt. This reduces the likelihood of expelled oil leaking between the belt and the inlet opening. In a preferred embodiment, the inlet opening is spaced about 10–150 mm, and more preferably not more than about 100 mm, from the upstream edge region of the shoe element.

The shoe press unit in a preferred embodiment comprises a closed shoe press unit, and the interior of the shoe press unit has an overpressure relative to the pressure outside the shoe press unit of 10–500 mbar. More preferably, the interior overpressure is below 200 mbar, and most preferably is below 50 mbar.

The oil evacuation duct in the bottom of the container can be connected to a vacuum source outside the shoe press unit to facilitate the evacuation of oil. In one embodiment of the invention, the evacuation duct is received within a recess in the beam of the shoe press unit such that the duct can freely move in the recess relative to the beam.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
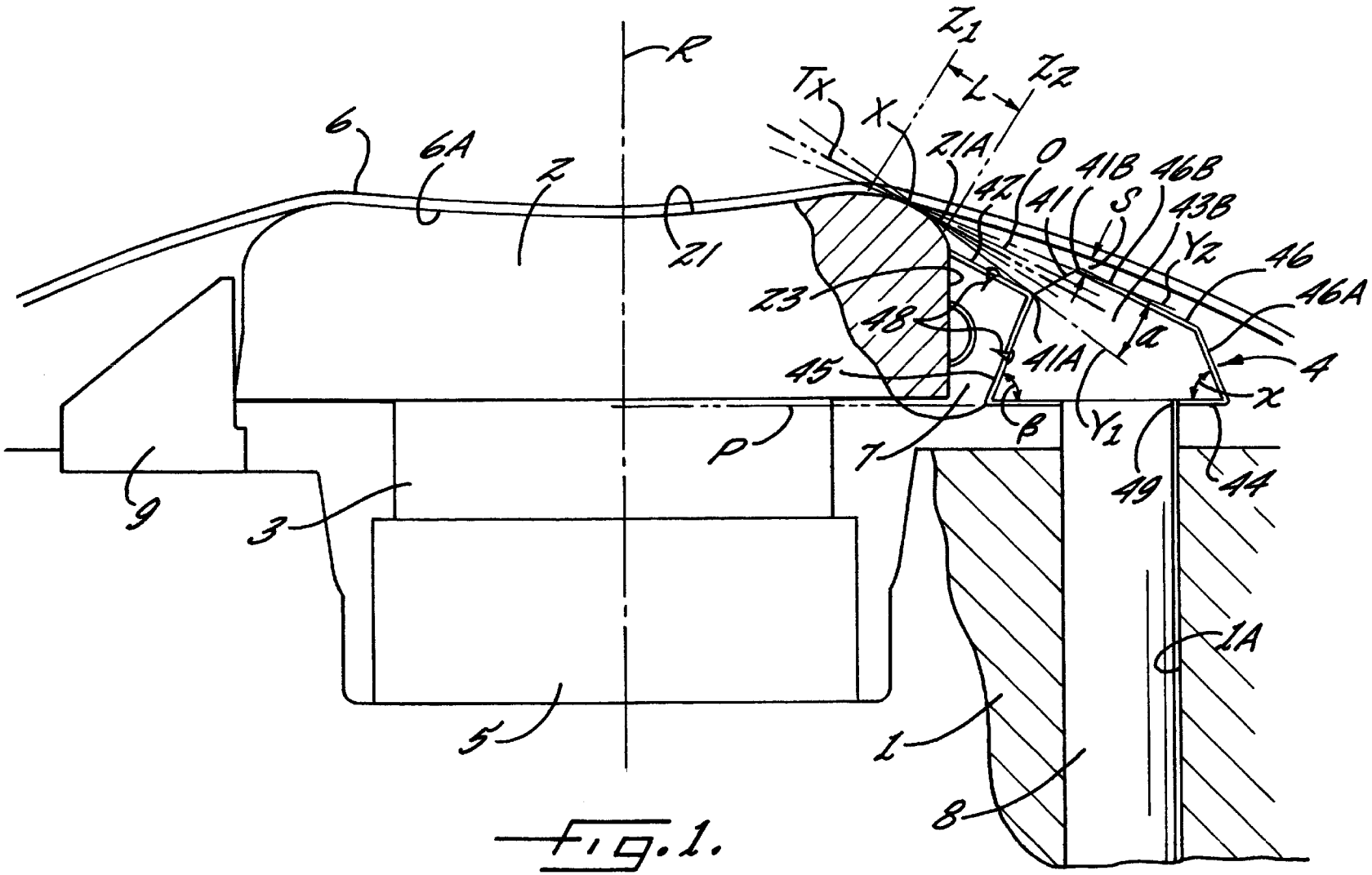
FIG. 1 is a side elevation, viewed in a cross-machine direction and partly in crosssection, of a shoe press unit in accordance with one preferred embodiment of the invention.

FIG. 1 shows, partly in cross section, a shoe press unit according to one embodiment of the invention. The shoe press unit comprises a support beam 1, in which a recess is arranged for a pressing unit 3, 5 for a shoe element 2. The pressing unit 3, 5 preferably comprises a hydraulic piston 3, which is arranged in a sealing manner inside a hydraulic cylinder 5, so that the shoe element 2 can be moved hydraulically back and forth in a direction R, which is at right angles in relation to the extent of the shoe element 2 in the longitudinal direction. A support heel 9 is arranged at one short end of the shoe element 2. An endless, flexible belt/jacket 6 is arranged so as to interact, by means of its one surface 6A, with a pressing surface 21 of the shoe element 2 and, by means of its other surface 6B, with a counter-roll (not shown). The endless belt 6 moves from right to left in FIG. 1. The heel 9 is therefore arranged at the downstream end of the shoe element 2. The shoe unit 2 is, according to the illustrated embodiment, symmetrically formed in each edge region of the pressing surface 21. In the upstream end of the shoe element 2 there is a marked end region $Z_1$–$Z_2$, which is a region with a convex curved surface 21A. As can be seen from the figure, the lengthwise extent L of the upstream edge region 21A is considerably shorter than the concave part 21 of the pressing surface. Within the upstream edge region 21A there is a transversely extending line X at which contact is first made between the belt 6 and the pressing surface 21 of the shoe unit.

At the upstream end of the shoe element is a distribution chamber 7 which in a known manner supplies the pressing surface 21 with oil via ducts (not shown). At said distribution chamber there is an oil evacuation arrangement 4 which comprises a guide plate or partition 42, a container part 45, 44, 46, 43A, 43B, an evacuation duct 8 and an inlet opening 41. The container part consists of a first longitudinal wall element 45, a plane bottom portion 44, a second longitudinal wall element 46 and two end walls 43A, 43B. The upstream longitudinal wall 46 is divided into a lower section 46A and an upper section 46B. The lower wall section 46A is arranged at an acute angle $\chi$ in relation to a plane P containing the plane bottom surface 44. According to the preferred embodiment, the angle $\chi$ is approximately 60–70°. The upper section 46B is arranged at a smaller acute angle in relation to the plane P. In this way, the upper section 46B preferably has an inclination that differs only by a few degrees from the tangent of the belt 6 in the region of the upper section 46B. The upper section therefore converges slightly towards the inner surface of the belt. The end 41B of the upper section forms an upper delimiting surface of the inlet opening 41, which is slot-shaped. It is advantageous that this upper delimiting surface 41B be positioned close to, or in certain cases even in contact with, the inner surface of the belt 6, so that as small a gap as possible is formed between them. The downstream wall element 45 is also arranged at an acute angle in relation to the plane P. According to the preferred embodiment, the downstream wall element 45 forms an angle $\beta$ which is essentially the same as the angle $\chi$ of the other wall element 46A. End walls 43A, 43B are arranged at either short end of the container. A lower delimiting surface 41A of the inlet opening 41 is formed by the upper edge of the downstream longitudinal wall element 45. All the components forming part of the container advantageously are made of thin sheet metal. In the preferred case, the sheet is 2 mm thick. Extending at right angles from the lower delimiting surface 41A in the direction of and up to the shoe element 2 is a guide plate or partition 42. The guide plate 42 is also made from thin sheet metal and it and the container are suitably made from one and the same piece of sheet metal which is suitably first stamped out and then bent into the desired final shape, after which the end walls 43A, 43B are connected in a sealing manner, suitably by means of welding, to the parts which have been bent up to form the container. Arranged in the bottom of the container is a circular hole 49, in which an evacuation pipe 8 is arranged in a sealing manner. Suitably, the evacuation pipe 8 is made of a sufficiently rigid material, e.g., metal, that it cannot be compressed by the outer overpressure normally existing inside the shoe press unit. The container portion is fixed by means of screw connections 48 to the distribution chamber 7 which is in turn connected (usually screwed) to one longitudinal side wall 23 of the shoe element. The evacuation arrangement 4 is therefore firmly anchored on the shoe element 2, so that these are movable as a unit. For the purpose of enabling movement of the shoe element and the evacuation arrangement 4, the support beam 1 includes a recess 1A, inside which the evacuation pipe 8 can move freely upwards and downwards.

As already mentioned, the evacuation arrangement 4 is positioned with its upper delimiting surface 41B of the inlet opening 41 relatively close to the surface of the belt, so that the distance S between them during operation is sufficiently small to prevent any significant quantity of oil escaping between the opening 41 and the belt 6. The distance S preferably should not exceed 10 mm. The inlet opening 41 should moreover be positioned in such a manner that the quantity of excess oil which is pressed out can squirt directly into the inlet opening 41. According to the preferred embodiment, this is brought about by virtue of the fact that the tangent Tx of the convex curved surface at the contact line X between the belt 6 and the shoe element 2 extends between the lower delimiting surface 41A and the upper delimiting surface 41B. In this case, the geometries between the edge region 21A and the inlet opening should be arranged so that the tangent Tx (which can be considered to represent a kind of median vector for the oil excess which normally squirts out in a divergent manner) of the contact line X deviates by a maximum of 15° from at least one of the imaginary straight lines Y1 and Y2 that extend respectively between the contact line X and the lower delimiting surface 41A and between the contact line X and the upper delimiting surface 41B of the inlet opening 41. Furthermore, the inlet opening 41 should be positioned close to the upstream edge region 21A, suitably spaced about 10–150 mm, but more preferably at a maximum of 100 mm, from the edge region 21A.

The device according to FIG. 1 functions in the following manner. When the machine is started up for operation, the inner surface of the belt is provided with an oil film in order to lubricate between the belt 6 and the pressing surface 21 of the shoe element 2 but also in order to cool the shoe press unit. Oil supply usually takes place in a number of different positions, including through the distribution chamber 7, which lubricates in the central zone of the pressing surface 21 and also usually at least somewhere else directly on the inner surface of the belt. The shoe element 2 exerts, through the force exerted by the pressing unit 3, 5, a pressure against a counter roll (not shown) so that a fibrous web disposed between the counter roll and the belt 6 is subjected to the desired treatment, for example, dewatering. In this connection, the excess oil that accompanies the belt 6 to the upstream end of the shoe element will be pressed out of the converging zone formed between the inner surface 6A of the belt and the upstream edge region 21A of the shoe element. The excess oil 0 is in this way given an initial kinetic energy and will squirt backwards, counter to the direction of movement of the belt, into the inlet opening 41 to be collected inside the container portion 43A, 43B, 44, 45, 46. By virtue of a slight overpressure inside the shoe press unit (when a closed shoe press unit is used), the oil collected in the container will be forced out through the evacuation pipe 8. In certain applications, the evacuation pipe 8 is connected to a source of vacuum (not shown) in order to ensure adequate oil evacuation. It is usual to try to operate a closed shoe press unit with an inner overpressure of less than 50 mbar.

A certain quantity of oil will not be forcibly expelled in a jet, but will instead follow the surface in the edge region 21A of the shoe element down towards the end wall 23 of the shoe element. By virtue of the guide plate 42, however, which bears against the end wall 23 of the shoe element, this quantity of oil will also be guided towards the inlet opening 41. In the embodiment shown in FIG. 1, gravity assists in this connection in bringing about this extra oil inflow to the container. It should be pointed out, however, that this is not a necessity because a certain underpressure can be brought about in the region adjacent to the inlet opening 41 so that this inflow of excess oil can take place even without the influence of gravity. The fact that the evacuation arrangement is arranged with the evacuation pipe vertical does not therefore constitute a limitation of the invention shown.

Figure 2:
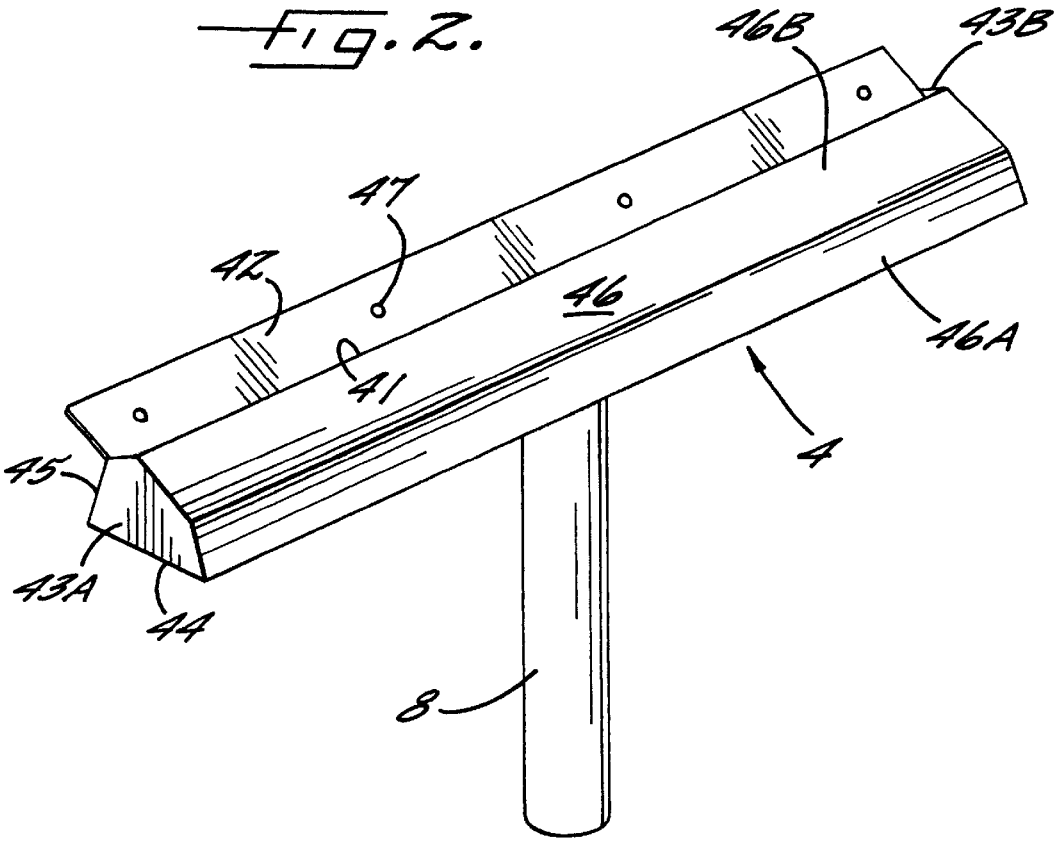
FIG. 2 is perspective view of an oil evacuation component in accordance with a preferred embodiment of the invention.

FIG. 2 shows in perspective the above-mentioned container portion 43A, 43B, 44, 45, 46 in the form of a unit with a guide plate 42 and an evacuation pipe 8. It can also be seen that the guide plate 42 is provided with a number of holes 47 for arranging fixing screws 48. By virtue of the fact that the evacuation arrangement is affixed to the shoe element 2, the inlet opening 41, which preferably extends along the entire width of the container, will always be optimally positioned in relation to the squirting oil irrespective of deflection of the beam 1.

Many modifications and other embodiments of the invention will come to mind to one skilled in the art to which this invention pertains having the benefit of the teachings presented in the foregoing descriptions and the associated drawings. For example, the evacuation arrangement can be made of many other materials than thin sheet metal, for example a polymer material. It is also clear that the inlet opening 41 of the evacuation arrangement can be divided (for example, for reasons of strength) so that a number of elongate openings next to one another is formed. It is also clear that the component parts of the evacuation arrangement do not necessarily have to made of/from one and the same material, but can be made from a number of different components/materials, which can be arranged with/connected to one another in many alternative ways that will be self-evident to the person skilled in the art. It is also clear that it is only for the purpose of exemplification that the evacuation arrangement is shown as being attached to a distribution block. The evacuation arrangement can of course be affixed directly on the shoe element 2, for example, along its side wall 23. In some cases, the evacuation arrangement can be firmly anchored to the pressing unit of the shoe element, which unit is movable together with the shoe element. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for operating a shoe press unit having a beam, a shoe element movably supported on the beam and having a pressing surface, a flexible belt arranged to slide over the pressing surface of the shoe element, and a pressing unit operable to urge the shoe element in a direction away from the beam, the method comprising:

supplying oil between the belt and the pressing surface of the shoe element for lubricating therebetween, excess oil being expelled under pressure from between the belt and the shoe element at an upstream edge region of the shoe element such that the excess oil exits from between the belt and shoe element with an initial kinetic energy; and capturing the excess oil expelled from between the belt and the shoe element with an oil evacuation arrangement formed separately from the shoe element and affixed to the shoe element such that the shoe element and oil evacuation arrangement move together as a unit, the oil evacuation arrangement having an inlet opening located with respect to the shoe element such that a major portion of the excess oil expelled from between the belt and the shoe element passes through the inlet opening with a kinetic energy that is substantially undiminished from the initial kinetic energy.

2. The method of claim 1, wherein the upstream edge region of the shoe element includes a convex curved surface and the belt is arranged to first contact the curved surface along a contact line X, and wherein the inlet opening is arranged such that a tangent $T_x$ to the curved surface at the contact line X extends into the inlet opening.

3. The method of claim 2, wherein the inlet opening is bounded on two opposite sides by first and second delimiting surfaces that extend in a cross-machine direction of the oil evacuation arrangement, and wherein the inlet opening is arranged such that there is not more than about 15 degrees deviation between the tangent $T_x$ and at least one of a first line Y1 that extends from the contact line X to the first delimiting surface and a second line Y2 that extends from the contact line X to the second delimiting surface.

4. The method of claim 3, wherein the tangent $T_x$ substantially coincides with one of the first and second lines Y1, Y2.

5. The method of claim 1, further comprising pressurizing an interior of the shoe press unit with an overpressure of about 10–500 mbar.

6. The method of claim 1, further comprising exerting a vacuum on the oil evacuation arrangement for facilitating evacuating the excess oil from the shoe press unit.

7. The method of claim 1, wherein a first delimiting surface of the inlet opening is closer to the upstream edge region of the shoe element than an opposite second delimiting surface of the inlet opening, and further comprising discouraging oil flow between the shoe element and the first delimiting surface by at least one partition that extends from a surface of the shoe element up to the inlet opening.

8. The method of claim 1, wherein the inlet opening is located at a distance of about 10–150 mm from the upstream edge region of the shoe element.

9. The method of claim 1, wherein a distance between the belt and a delimiting surface of the inlet opening nearest the belt is not greater than about 10 mm during operation.

10. A shoe press unit, comprising:

a beam;

a shoe element movably supported on the beam and having a pressing surface and an upstream edge region;

a pressing unit for urging the shoe element in a direction away from the beam;

a flexible belt arranged to slide over the pressing surface of the shoe element, oil being supplied between the belt and the pressing surface for lubricating the belt, an excess oil being expelled under pressure from between the belt and the shoe element at the upstream edge region of the shoe element such that the excess oil exits from between the belt and shoe element with an initial kinetic energy; and an oil evacuation arrangement formed separately from the shoe element and removably affixed to the shoe element proximate the upstream edge region thereof such that the shoe element and oil evacuation arrangement move together as a unit, the oil evacuation arrangement having an inlet opening located with respect to the shoe element such that a major portion of the excess oil expelled from between the belt and the shoe element passes through the inlet opening with a kinetic energy that is substantially undiminished from the initial kinetic energy.

11. The shoe press unit of claim 10, wherein the upstream edge region of the shoe element includes a convex curved surface and the belt is arranged to first contact the curved surface along a contact line X, and wherein the inlet opening is arranged such that a tangent $T_x$ to the curved surface at the contact line X extends into the inlet opening.

12. The shoe press unit of claim 11, wherein the inlet opening is bounded on two opposite sides by first and second delimiting surfaces that extend in a cross-machine direction of the oil evacuation arrangement, and wherein the inlet opening is arranged such that there is not more than about 15 degrees deviation between the tangent $T_x$ and at least one of a first line Y1 that extends from the contact line X to the first delimiting surface and a second line Y2 that extends from the contact line X to the second delimiting surface.

13. The shoe press unit of claim 12, wherein the tangent $T_x$ substantially coincides with one of the first and second lines Y1, Y2.

14. The shoe press unit of claim 10, wherein the oil evacuation arrangement includes a container having a bottom and a plurality of wall elements upstanding from the bottom and defining a first delimiting surface of the inlet opening spaced relatively farther from the belt and a second delimiting surface of the inlet opening spaced relatively closer to the belt, the bottom of the container having an oil evacuation duct provided therein.

15. The shoe press unit of claim 14, wherein the oil evacuation arrangement further comprises at least one partition extending from a surface of the shoe element to the inlet opening for discouraging oil flow between the shoe element and the first delimiting surface.

16. The shoe press unit of claim 15, wherein the partition comprises sheet metal.

17. The shoe press unit of claim 16, wherein the container bottom and wall elements comprise sheet metal and the partition is formed integrally with one of the wall elements.

18. The shoe press unit of claim 14, wherein the oil evacuation duct is received in a recess in the beam such that the duct can freely move within the recess relative to the beam.

19. The shoe press unit of claim 14, wherein the second delimiting surface of the inlet opening is spaced not more than about 10 mm from the belt during operation.

20. The shoe press unit of claim 10, wherein the inlet opening is spaced about 10–150 mm from the upstream edge region of the shoe element.

* * * * *